US006494136B1

(12) United States Patent
Zimmer

(10) Patent No.: US 6,494,136 B1
(45) Date of Patent: Dec. 17, 2002

(54) DEVICE AND PROCESS FOR SMOOTHING PRINTING SCREENS FOR SILK SCREEN PRINTING

(75) Inventor: Peter Zimmer, Kufstein (AT)

(73) Assignee: Peter Zimmer KEG, Kufstein (AT)

( * ) Notice: Subject to any disclaimer, the term of this patent is extended or adjusted under 35 U.S.C. 154(b) by 0 days.

(21) Appl. No.: 09/597,446

(22) Filed: Jun. 20, 2000

(30) Foreign Application Priority Data

Jun. 21, 1999 (AT) ..... 1085/99

(51) Int. Cl.[7] ..... B41F 35/00

(52) U.S. Cl. ..... 101/425; 101/424

(58) Field of Search ..... 101/424, 425, 101/116, 423

(56) References Cited

FOREIGN PATENT DOCUMENTS

DE 4224511 A1 1/1994

*Primary Examiner*—Ren Yan
(74) *Attorney, Agent, or Firm*—Lorusso & Loud

(57) ABSTRACT

Device and process for smoothing printing screens for silk screen printing, in particular rotary screens, liquid being sprayed at high pressure onto a screen (1, 1') lying on a compression-resistant and dimensionally stable support.

11 Claims, 4 Drawing Sheets

DEVICE AND PROCESS FOR SMOOTHING PRINTING SCREENS FOR SILK SCREEN PRINTING

BACKGROUND OF THE INVENTION

The present invention relates to a device as well as a process for smoothing printing screens for silk screen printing, in particular rotary screens.

Printing screens for silk screen printing consist of nickel foil, which is so thin that it can be easily creased during the process or by the operator's carelessness. Crease marks however disrupt the uniform pattern application, which is why they have to be removed before the printing screen for silk screen printing can be re-used.

The device according to the invention achieves this object by the fact that a compression-resistant and dimensionally stable support preferably developed as a rotatable support roller for the screen as well as a nozzle unit for spraying a jet of liquid onto the screen at high pressure are provided, the screen lying on the support at least in the working area of the nozzle unit.

The process according to the invention provides for a liquid to be sprayed at high pressure onto a screen lying on a compression-resistant and dimensionally stable support.

The device according to the invention as well as the associated process are based on devices which are used for the removal of a varnish deposited for patterning purposes on the outside of the printing screen for silk screen printing. For this process, called "stripping", it is known to spray water at high pressure onto the printing screen for silk screen printing. A corresponding device is shown for example in DE 42 24 511 A1. For the known device, the support roller is formed by an inflatable supporting tube which is enclosed by a thin metal foil. The result of this is that the support roller is deformed under the pressure of the impacting jet of liquid which is why, for the known device, crease marks additional to the already present creases occur during the "stripping" in most cases.

On the other hand, if the support is formed from compression-resistant and dimensionally stable material, then a hard and unyielding abutment is obtained on which the placed screen is smoothed by the action of the jet of liquid. The development of the support as a support roller is particularly advantageous in design terms.

SUMMARY OF THE INVENTION

The smoothing effect occurs in particular at pressures above 1000 bar, a pressure of approx 2000 bar preferably being used.

A support or support roller made from high-grade steel has proved to be a suitably hard abutment. Other hard material can also be used however, such as for example a roller treated with hard chromium.

An optimal smoothing effect is achieved if the distance between the nozzle tip of the nozzle unit and the screen laid on the support roller is between 5 mm and 20 mm, preferably between 8 mm and 10 mm.

In order to be able to use the device according to the invention for any screen size, it is favourable if the device has a free space beneath the support roller for a screen section suspended freely beneath the support roller. Using the free space beneath the support roller, it is possible for the support roller to be relatively small, so that, even for the smallest rotary screen size, only a part of the screen lies on the support roller, whereas a freely suspended screen section finds space beneath the support roller. Thus, a uniform support roller can be used for all rotary screen sizes.

Not only is a smoothing of the screen achieved by the device according to the invention but also a removal of the varnish deposited for patterning purposes, as is already known. In this connection it is favourable if a rinsing device is provided beneath the support roller for the freely suspended screen section. The function of the rinsing device is to remove separated colour particles from the freely suspended screen section.

In order to ensure a full fit of the screen in the working area of the nozzle unit, a pressure roller for pressing the screen against the support roller can be preferably provided. For adaptation to different screen widths, it is advantageous if the width of the pressure roller can be changed by means of additional elements.

It is favourable if the support roller has areas, with slightly increased diameter, which form stops. The two stops form a lateral limitation for the screen pushed onto the support roller, whereby a lateral "downward migration" of the screen on the side is avoided during the course of the rotary movement of the support roller. For adaptation to different screen widths, it is advantageous if at least one of the areas is designed to be displaceable, preferably as a displaceable sleeve.

Furthermore it can be provided that the support roller is clamped or housed on one side. The cantilevered arrangement of the support roller makes it possible to push the rotary screens from the free side in axial direction onto the support roller.

Further details and features of the present invention emerge from the following description of the figures. These show:

DETAILED DESCRIPTION OF THE INVENTION

Figure 1:
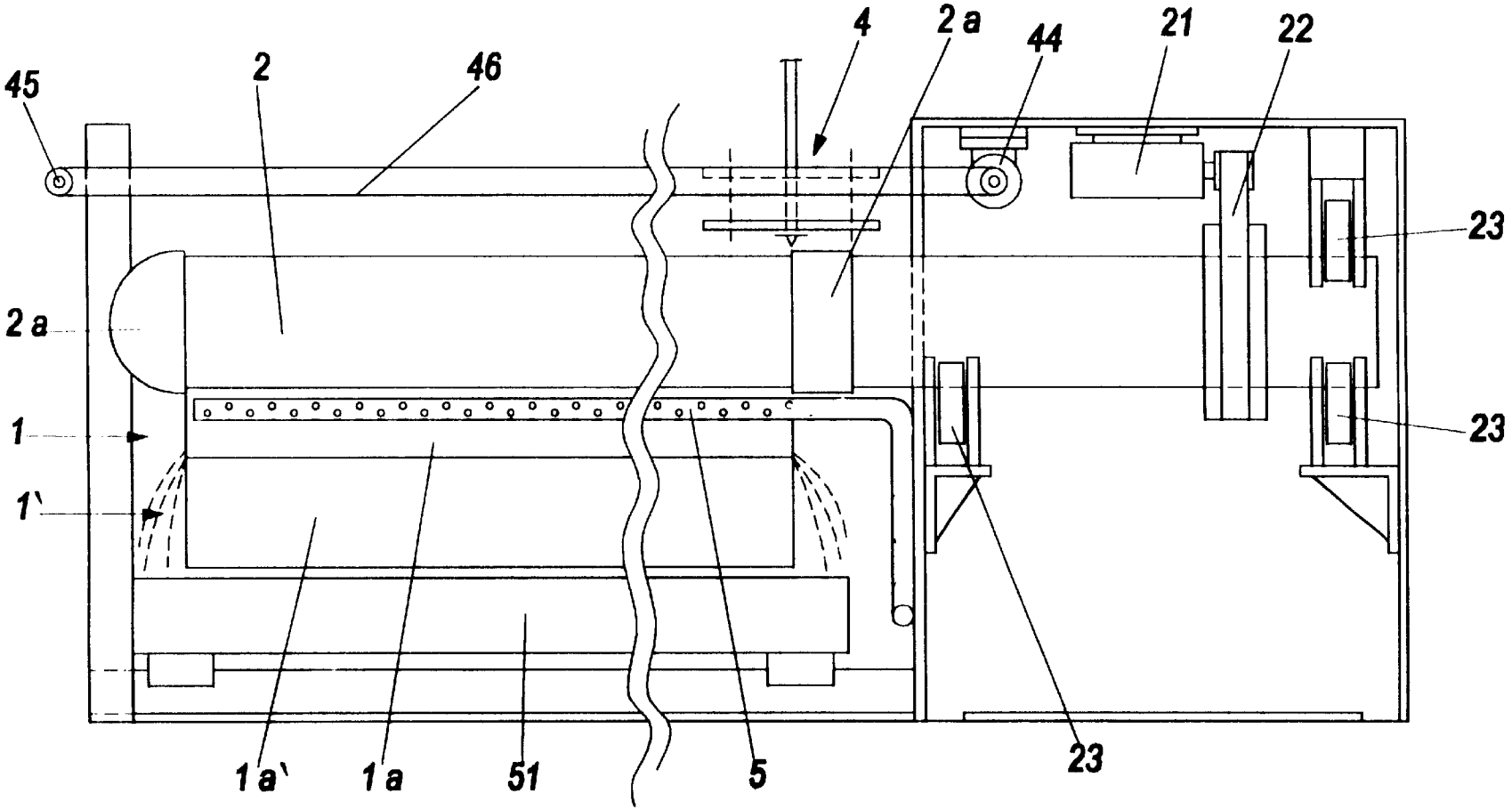
FIG. 1 a partly sectioned front view of a device according to the invention, FIG. 2 an associated side view, FIG. 3 a further side view from the opposite side and FIGS. 4*a* and 4*b* a detail of a particular embodiment.
Figure 2:
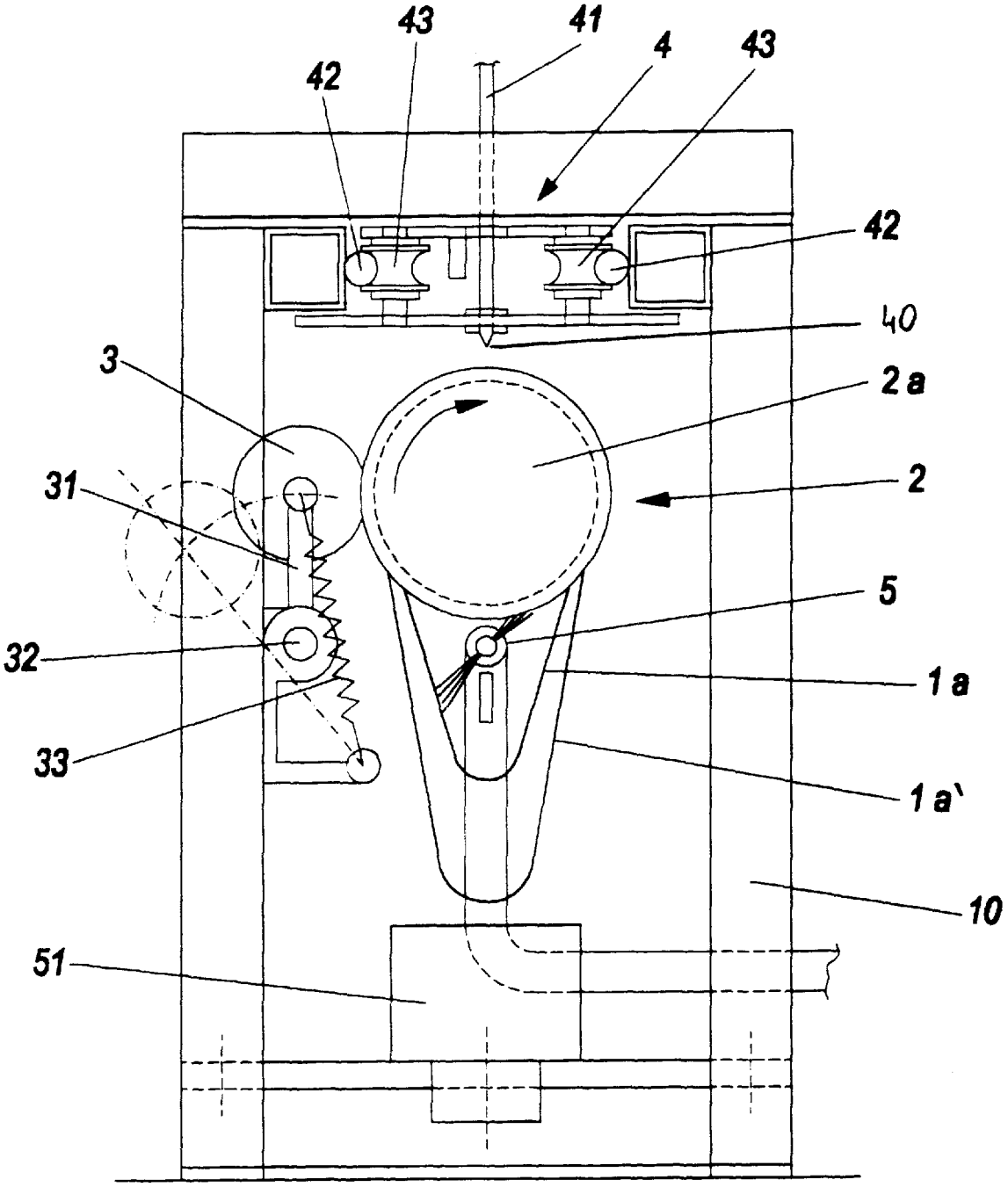
Figure 3:
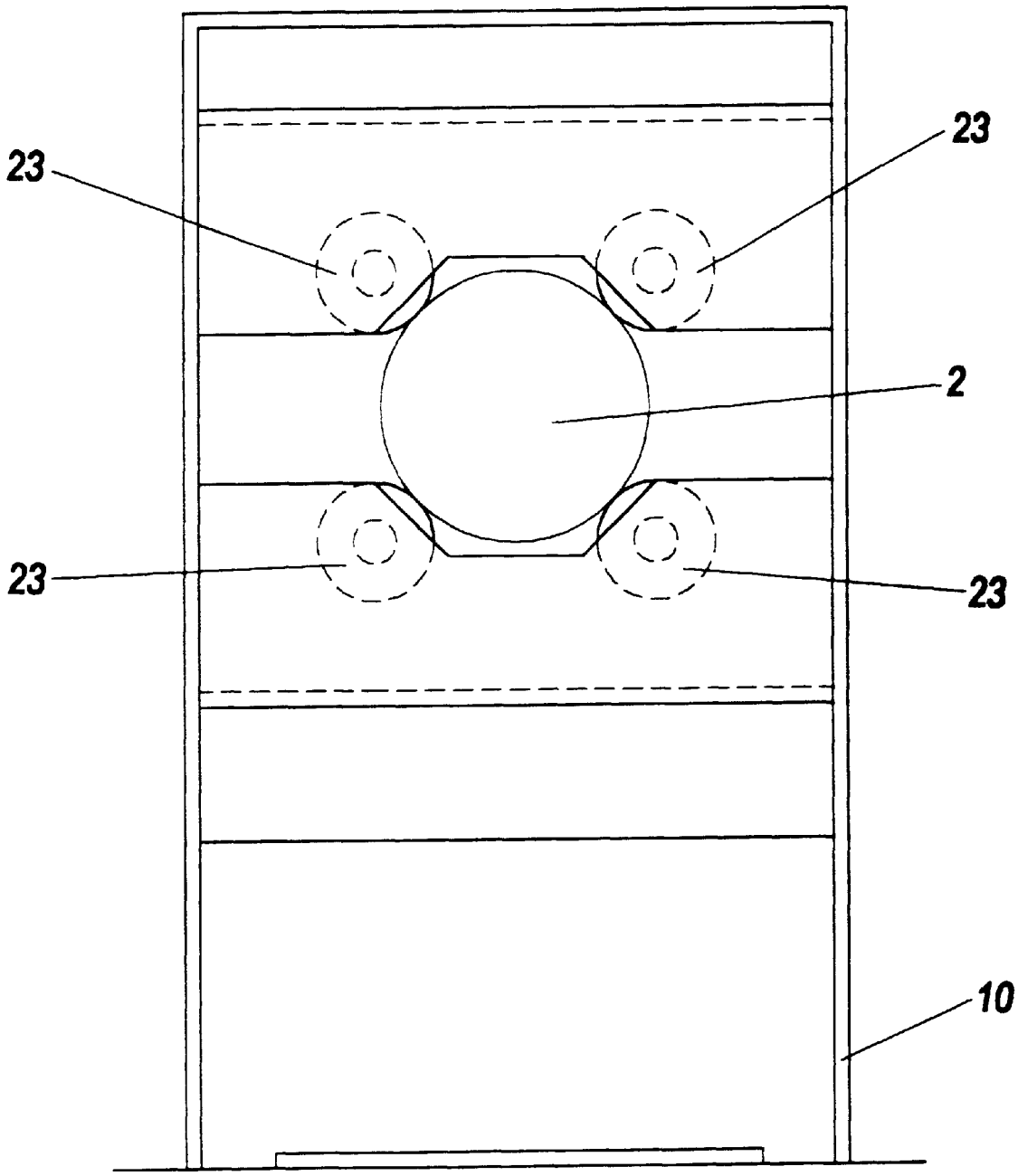

The central element of the device according to the invention shown in FIGS. 1 to 3 is the support roller 2. The screens 1, 1' to be cleaned are pushed onto this support roller 2. The support roller 2 is designed as a tube and is made from stainless high-grade steel, whereby it is compression-resistant and dimensionally stable to a high degree.

In order to set the support roller 2 rotating, a drive unit 21 is provided which is connected to the support roller 2 by means of a belt 22. The rotation speed of the support roller 2 can be variably adjusted and is preferably in the range of approx one revolution per second.

The support roller 2 is arranged cantilevered on the basic frame 10, i.e. it is clamped or housed on one side only. To this end, bearing rollers 23 are provided, four of which are provided at a first point and two of which at a second point. The cantilevered arrangement of the support roller 2 is essential inasmuch as the screen 1, 1' to be cleaned can be pushed onto the support roller 2 without difficulty from the free end.

The support roller 2 has two areas 2*a* with slightly increased diameter. These areas form stops for the screen 1, 1' which has been laid on, and prevent a lateral "downward migration" during the course of the rotary movement of the support roller 2. The area 2*a* at the free end of the support roller 2 is designed in addition as a rounded nose, whereby the threading of the screen 1. 1' onto the support roller 2 is made easier.

Two different screens 1, 1' are drawn in the figures, which differ in circumference and thus hang down to different extents into the free space beneath the support roller 2. The associated freely suspended screen section is numbered 1*a*, 1*a'*. The diameter of the support roller 2 is favourably somewhat smaller than the diameter of the smallest screen 1, 1' to be cleaned, so that all screen sizes can be pushed onto the support roller 2 without difficulty.

Liquid is sprayed on by means of the nozzle unit 4 via which water with or without additives is sprayed on at high pressure. The pressure is in the range between 1000 to 2500 bar, operation at approx 2000 bar being preferred. The optimal distance from the nozzle tip 40 to the screen 1, 1' is between 5 mm and 20 mm. more precisely between 8 mm and 10 mm. The liquid is supplied via a high-pressure pump, not shown, which is connected to the supply pipe 41. The high pressure is essential inasmuch as the screen 1, 1' is thereby not only cleaned in known manner but also smoothed at the same time. This happens in cooperation with the support roller 2 made from high-grade steel. After being treated on the device according to the invention the screen 1, 1' is thus not only freed of any screen coating, but also has no more crease marks.

In addition it should be mentioned that the circumference of the support roller is also cleaned, in order that no particles on this interrupt the full fit of the screen against the support roller.

During spraying of the liquid, the support roller 2 is rotated on the one hand, the screen 1, 1' being entrained by the contact pressure of the liquid. The nozzle unit 4 carries out a feed movement at the same time, for which a drive unit 44 is provided. The nozzle unit 4 is guided by means of guide rods 42 and guide rollers 43, the connection between the drive device 44 and the nozzle unit 4 being created via a toothed belt 46. This is reversed at a reversing roller 45. As an alternative to the drive shown, a feed rod drive or similar is also conceivable, however.

The feed is matched to the rotation speed of the support roller 2 as well as the width of the nozzle jet, so that a closed surface results which has been treated by the water jet. The closed surface is formed from slightly overlapping spiral strips.

The jet of liquid impacts essentially at the zenith on the support roller 2, a slight inclination relative to the vertical being possible.

In order to remove with certainty from the screen 1, 1' the varnish particles detached by the nozzle jet, a rinsing device 5 is furthermore provided. This rinsing device 5 is developed as a perforated tube through which liquid is sprayed from the inside onto the screen 1, 1'. The liquid, preferably water, is collected in collection tank 51 and can be re-used after passing through a fine-filter unit. In this way, water consumption is kept low.

In order to position the screen 1, 1' securely on the support roller 2, a pressure roller 3 is provided which is shown only in FIG. 2. The pressure roller 3 extends in the area between the areas 2*a* with increased diameter of the support roller 2 and thus presses the screen 1,1' over its entire width against the support roller 2. The pressure roller 3 is held at the sides by arms 31, which can be pivoted about an axis 32. The pressure roller 3 is held in its end-positions by springs 33.

Figure 4A:
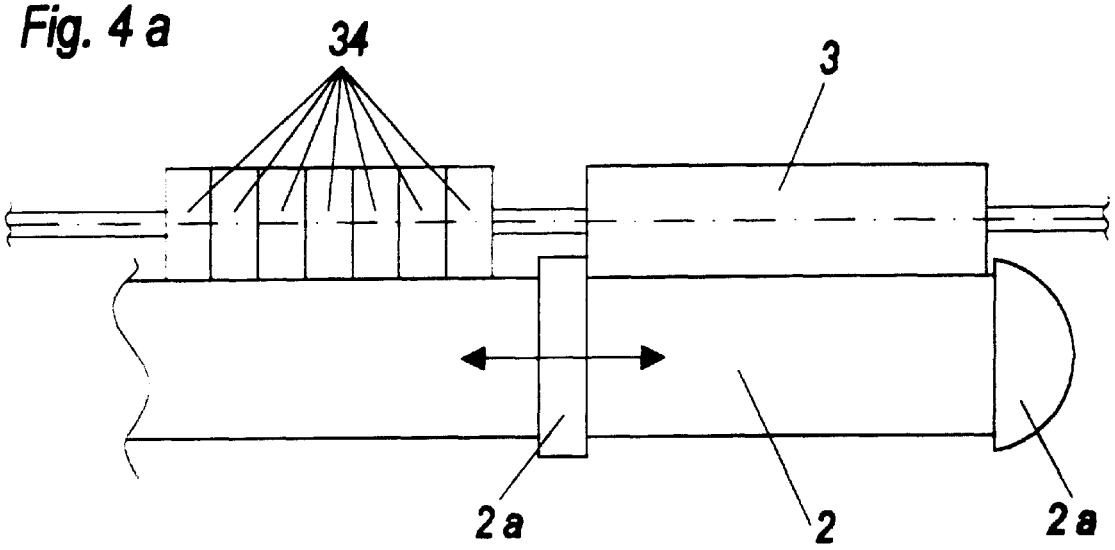
Figure 4B:
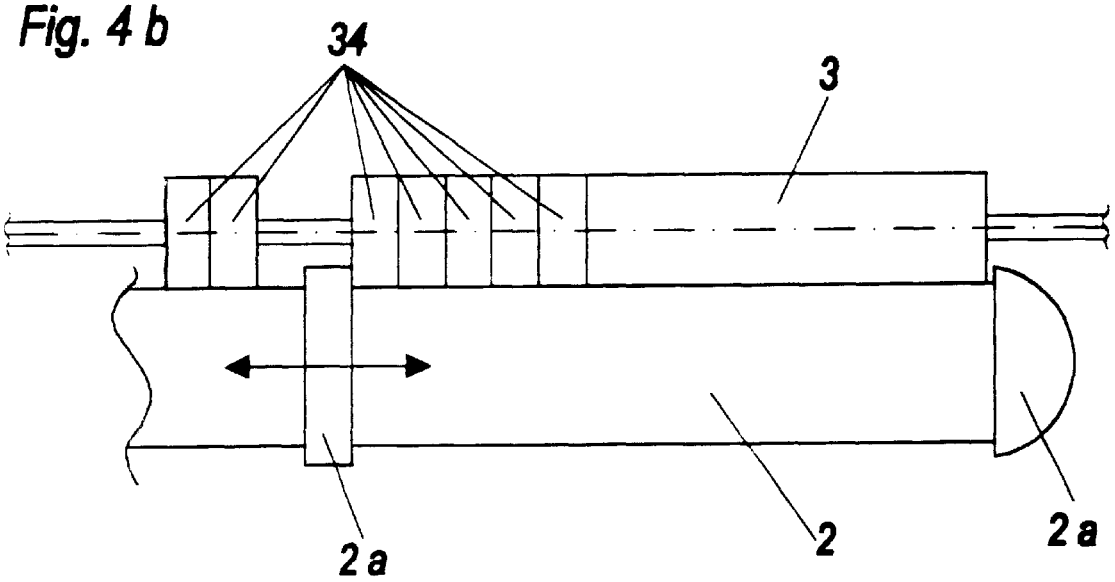

A special development of the pressure roller 3 is shown in FIGS. 4*a* and 4*b*. For optimal adaptation to the width of the screen, a plurality of additional elements 34 can be provided which can be pushed against the pressure roller 3. In addition, the area 2*a* forming a lateral stop, is developed as a displaceable sleeve.

The principle according to the invention is also suitable for smoothing flat screens. A flat support must be used instead of the support roller, by way of deviation from the above embodiment.

What is claimed is:

1. Device for smoothing printing screens for screen printing, in particular rotary screens, wherein a compression-resistant and dimensionally stable support, preferably developed as a rotatable support roller for the screen as well as a nozzle unit for spraying a jet of liquid onto the screen at high pressure are provided, the screen lying on the support at least in the working area of the nozzle unit, wherein beneath the support roller the device has a free space for a screen section freely suspended beneath the support roller and wherein a rinsing device is provided beneath the support roller for the freely suspended screen section.

2. Device according to claim 1, wherein the pressure is between 1000 and 2500 bar.

3. Device according to claim 2, wherein the pressure is 2000 bar.

4. Device according to claim 1, wherein the support or support roller is made of metal.

5. Device according to claim 4, wherein the support or support roller is made of high grade steel.

6. Device according to claim 1, wherein the distance between the nozzle tip of the nozzle unit and the screen lying on the support roller is between 5 mm and 20 mm.

7. Device according to claim 6, wherein the distance between the nozzle tip of the nozzle unit and the screen lying on the support roller is between 8 mm and 10 mm.

8. Device according to claim 1, wherein the nozzle unit is arranged above the support roller and the jet of liquid is essentially vertically directed.

9. Device according to claim 1, wherein a pressure roller is arranged for pressing the screen against the support roller.

10. Device according to claim 1, wherein the support roller has areas with slightly increased diameter which form stops.

11. Device according to claim 1, wherein the support roller is clamped or housed on one side.

* * * * *